US005881418A

United States Patent [19]

Enoch

[11] Patent Number: 5,881,418

[45] Date of Patent: Mar. 16, 1999

[54] HOLLOW WARE WASHING DEVICE

[76] Inventor: Robert B. Enoch, 3304 Harding, Dearborn, Mich. 48124

[21] Appl. No.: 990,594

[22] Filed: Dec. 15, 1997

[51] Int. Cl.[6] ..... A47L 17/00; A46B 11/04

[52] U.S. Cl. ..... 15/101; 15/29; 15/97.1

[58] Field of Search ..... 15/23, 24, 28, 15/29, 97.1, 97.2, 101

[56] References Cited

U.S. PATENT DOCUMENTS

| | | | |
|---|---|---|---|
| 3,177,510 | 4/1965 | Mack . | |
| 3,195,537 | 7/1965 | Blasi | 15/29 |
| 3,204,273 | 9/1965 | Gallo . | |
| 3,387,312 | 6/1968 | Westphal . | |
| 4,168,560 | 9/1979 | Doyel . | |
| 4,335,481 | 6/1982 | Slayman | 15/29 |
| 4,379,355 | 4/1983 | Kobayashi et al. . | |
| 5,208,933 | 5/1993 | Lustig et al. | 15/29 |
| 5,423,102 | 6/1995 | Madison | 15/29 |
| 5,649,334 | 7/1997 | Henriquez et al. | 15/97.1 |
| 5,680,666 | 10/1997 | Ra | 15/29 |
| 5,700,146 | 12/1997 | Kucar | 15/24 |
| 5,701,625 | 12/1997 | Siman | 15/97.1 |

*Primary Examiner*—Terrence R. Till
*Attorney, Agent, or Firm*—Charles W. Chandler

[57] ABSTRACT

A portable device for washing drinking glasses includes a hollow tubular handle containing a rotary shaft, drive motor, and dry cell battery. A circular sponge cleaning element is attached to the external end of the rotary shaft for cleaning the interior surface of a drinking glass enclosing the sponge element. The hollow handle provides a storage chamber for liquid detergent that can be delivered through an axial passage in the shaft to the sponge element. Handle construction is simplified by forming the handle in two sections split on the handle longitudinal axis; a single gasket is interposed in the plane of the split to seal the longitudinal joint between the two handle sections.

17 Claims, 2 Drawing Sheets

HOLLOW WARE WASHING DEVICE

BACKGROUND AND SUMMARY OF THE INVENTION

This invention relates to a device for washing hollow ware, e.g. drinking glasses, cups, and bottles. More particularly, the invention concerns a manual device having a hollow tubular handle and an elongated rotary shaft that carries a sponge-type cleaning element. A battery-powered electric motor in the handle powers the shaft for rotary motion. The device can be held in a person's hand, with the shaft and cleaning element inserted into a drinking glass or other hollow ware item for washing the interior surface of a drinking glass.

The use of rotary cleaning devices is old in the prior art. U.S. Pat. No. 3,387,312 to W. Westphal discloses a rotary cleaning device for cleaning toilets, bathtubs and tile walls. The device comprises an electric motor within an elongated housing for imparting a rotary oscillating motion to an associated shaft; a hemispheric sponge on the free end of the shaft performs the cleaning function.

U.S. Pat. No. 3,204,273 to J. Gallo, discloses a stationary machine locatable in a sink for cleaning a drinking glass as it is lowered onto a rotary brush slightly below the sink water level. A motor in the machine spins the rotary brush to clean the interior surface of the glass.

U.S. Pat. No. 3,177,510 shows a device for cleaning a person's teeth. The device comprises a hollow handle containing an electric motor, a dry cell battery for powering the motor, and an elongated shaft driven by the motor. A compressible tube containing a supply of toothpaste delivers toothpaste to the shaft and a cleaning brush attached to the shaft.

U.S. Pat. No. 4,168,560 discloses a general purpose cleaning device that includes a reservoir for a liquid cleaning agent, and a manual valve for delivering small quantities of the cleaning agent to a rotary brush. A battery-operated motor in the handle powers the brush.

U.S. Pat. No. 4,379,355, to K. Kobayaski, discloses a non-powered device for cleaning hollow ware. The person moves a drinking glass or other hollow item over a sponge cleaning element that is mounted for rotation on a stationary housing. Manual manipulation of the drinking glass causes the sponge element to effect a cleaning operation on the glass surface.

The present invention relates to a portable hand-held cleaning device for hollow ware, comprising a hollow tubular handle containing a battery-powered electric motor, and a rotary shaft driven at reduced speed by the motor. A circular sponge cleaning element on the outer end of the shaft cleans a piece of hollow ware held against the cleaning element surface.

The hollow tubular handle is split on its longitudinal axis into two mating handle sections, for easy assembly of the motor, battery, shaft and speed reducer gearing in the handle. The joint between the two handle sections is sealed by an endless gasket that extends around the handle periphery and transversely across edge areas of partition walls within the handle sections.

In order to simplify the gasket sealing contact and gasket construction, the shaft is offset from the handle's longitudinal axis. This enables the gasket to be a single planar unit adapted to have good uninterrupted sealing contact along its entire length. The handle is effectively sealed against the entrance of moisture without using complex sealing constructions. Assembly of the cleaning device components into an operative structure is accomplished in the manufacturing facility with a minimum number of assembly operations.

Further features of the invention will be apparent from the attached drawings and description of an illustrated embodiment of the invention.

DESCRIPTION OF A PREFERRED EMBODIMENT OF THE INVENTION

Figure 1:
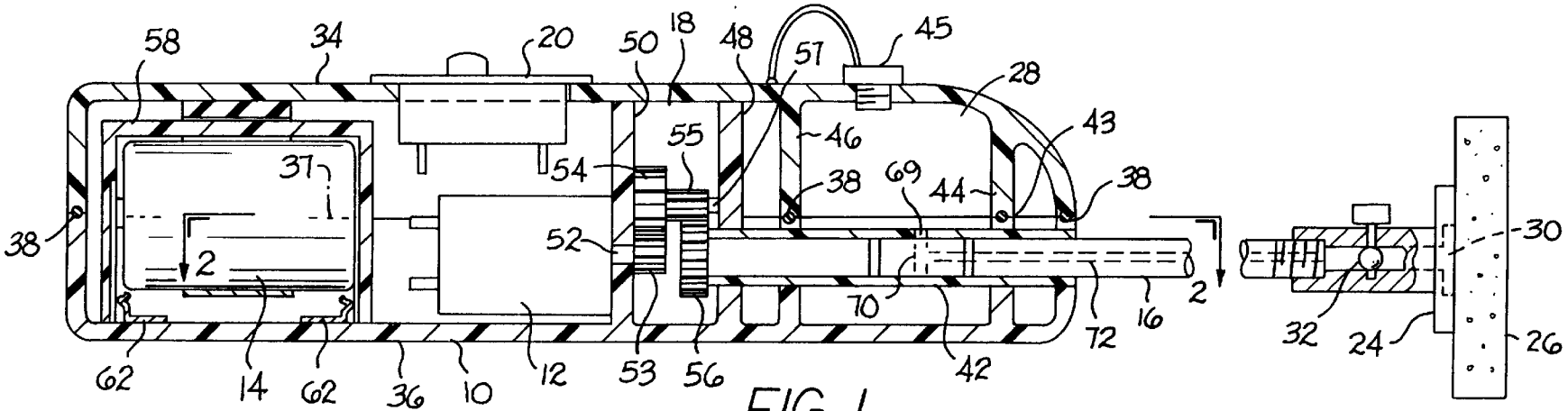
FIG. 1 is a longitudinal sectional view taken through a portable washing device embodying the invention.
Figure 2:
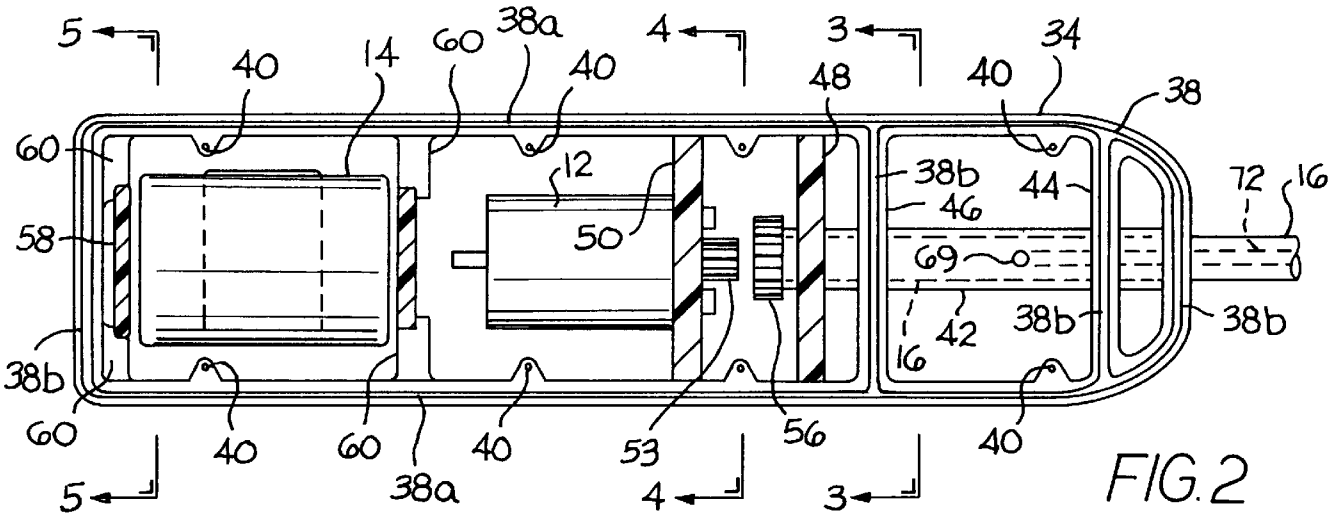
FIG. 2 is a sectional view taken on line 2—2 in FIG. 1.

FIGS. 1 and 2 illustrate a preferred form of the invention. The invention comprises a portable washing device that includes a hollow tubular handle 10 that houses an electric motor 12, dry cell battery 14 for energizing the motor, and a rotary shaft 16 powered by the motor. Speed reducer gearing 18 is located between the motor and shaft 16, whereby the shaft is rotated at reduced speed (compared to the motor speed).

Motor 12 is turned on or off by a manual switch 20 that is electrically located in the circuit established between nickel cadmium battery 14 and motor 12.

Shaft 16 has an external shaft section that connects with a mounting pad 24 for a sponge cleaning element 26. Liquid detergent is supplied to the sponge cleaning element from a detergent storage chamber 28 located in handle 10. The liquid detergent travels from chamber 28 through a passage in shaft 16, and then into a small chamber 30 in pad 24 for distribution into the pores in sponge element 26. As an optional feature, a small manual butterfly valve 32 can be provided on pad 24 for shutting off the flow of liquid detergent to sponge element 26, e.g. when it is desired to use the sponge element during a rinsing operation.

Figure 3:
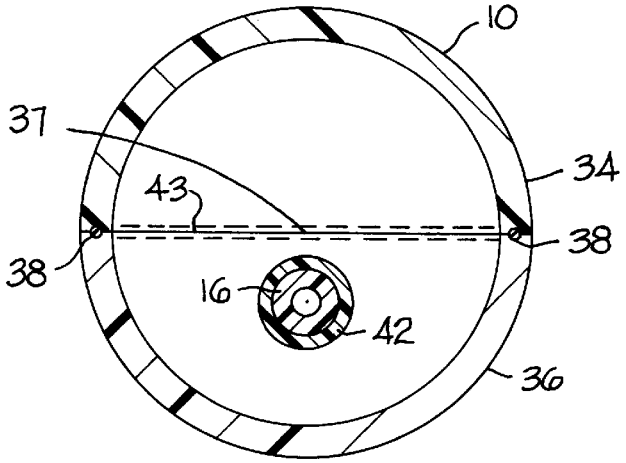
FIG. 3 is a transverse sectional view taken on line 3—3 in FIG. 2.
Figure 4:
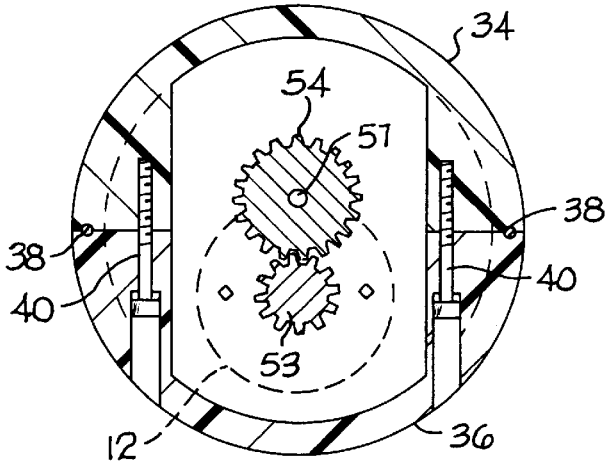
FIG. 4 is a transverse sectional view taken on line 4—4 in FIG. 2.
Figure 5:
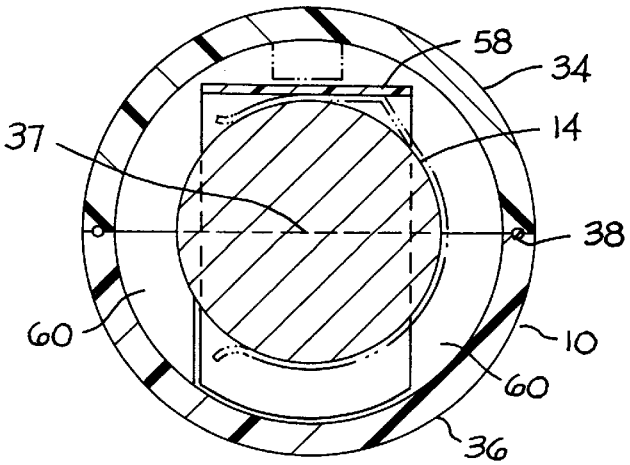
FIG. 5 is a transverse sectional view taken on line 5—5 in FIG. 2.

As shown in FIGS. 3 through 5, handle 10 has a circular cross section. The handle diameter may be about two and one quarter inches, such that the user can grasp the handle to manually insert the sponge cleaning element 26 into a drinking glass while the element is being rotated by shaft 16. Sponge cleaning element 26 has a cylindrical shape formed about the shaft's rotational axis, whereby the rotating sponge element can exert a wiping action on the interior surface of the drinking glass, bottle, or other hollow ware item being washed. The diameter of the sponge element is preferably about the same as the diameter of handle 10, e.g., about two and one quarter inches. The sponge element can fold or curl in order to penetrate small diameter drinking glasses, i.e. smaller than a two inch interior diameter.

A major feature of the invention is the construction of handle 10. As shown in FIG. 1, the handle is split into two handle sections 34 and 36 on a plane containing the central axis 37 generated by the circular handle configuration. In FIG. 1 the split between handle sections 34 and 36 coincides with section line 2—2. FIG. 2 shows the configuration of handle section 36 in the plane of the split between the two handle sections; handle section 34 has a similar shape in the split plane.

An endless sealing gasket 38 is interposed between handle sections 34 and 36 in the plane of the split between the two sections. The gasket comprises multiple limbs, or branches, extending within mating grooves in the facing edges of handle sections 34 and 36. As viewed in FIGS. 3 through 6, each gasket limb has a circular cross sectional shape mated to the semi-circular cross-sectioned grooves formed in the facing edges of the handle sections 34 and 36. The circular cross section of the gasket limb is slightly oversize relative to the groove cross sectional dimensions, whereby the gasket material is compressed when the two handle sections 34 and 36 are mated together, as in FIGS. 3 through 6. The gasket is formed of a resilient elastomeric material.

Referring to FIG. 2, sealing gasket 38 includes two elongated limbs 38*a* extending along the longitudinal side edges of handle 10, and four transverse limbs 38*b* connecting limbs 38*a* at spaced points along the length of handle 10. The entire gasket is preferably formed as a unitary endless one-piece elastomeric structure capable of being installed as a unit on the edge area of handle section 36 (or handle section 34). After installation of the gasket, the two handle sections 34 and 36 are mated together, as in FIGS. 3 through 6.

Handle sections 34 and 36 are held together by plural screws 40 extending from handle section 36 into handle section 34 at spaced points along the length of the handle. As shown in FIG. 2, eight screws join the two handle sections. The number of screws is not critical. FIG. 4 shows an illustrative disposition of the connecting screws 40. Each screw has a head located within a countersunk opening in handle section 36, and a threaded shank in mesh with a threaded hole in handle section 34. A sealing gasket is provided around the screw shank proximate to the screw head, to prevent inadvertent migration of moisture into the handle interior space.

It will be seen from FIG. 1 that rotary shaft 16 is offset from the plane of the split between handle sections 34 and 36. Shaft 16 is rotatably mounted in a tubular guide 42 that extends through the handle end wall and also through partitions 44, 46 and 48 formed integrally with handle section 36. Circular holes in the partitions have close fits on the tubular guide 42, supplemented by solvent adhesives around the guide 42 surface, whereby the tubular guide has a leak-proof joint with each partition.

Partitions 44 and 46 are each formed by two aligned walls integral with the respective handle sections 34 and 36. These aligned walls have free linear edges 43, that meet in the plane of the split between the handle half sections 34 and 36. One limb of gasket 38 extends within mating grooves on the wall edges 43 to seal the joint between the aligned walls that define partition 44 or partition 46. Partitions 44 and 46 form the axial limits of detergent chamber 28. Liquid detergent can be added to chamber 28 by pouring the detergent through an opening that is normally closed by screw-on cap 45. A flexible cord 47 connects the cap 45 to middle section 34 to prevent the inadvertent loss of the cap.

Motor 12 is mounted on a fourth partition 50 that parallels partition 48. Each partition 48 or 50 is integral with handle half section 36. As shown in FIG. 1, partitions 48 and 50 extend beyond the plane of the split between the two handle sections so as to engage the interior circular surface of half section 34. Partitions 48 and 50 define the axial limits of a gear chamber that contains speed reducer gears connecting motor 12 to shaft 16.

Motor 12 has a drive shaft 52 connected to a small pinion gear 53 that is in mesh with a larger pinion gear 54. A second small pinion gear 55 is integral with gear 54 so as to mesh with a larger pinion gear 56 carried by shaft 16. The integral gears 54 and 55 are rotatably mounted on a pin 57 that extends between partitions 48 and 50. The gear system provides a desired speed reduction between motor 12 and shaft 16.

Battery 14 can be mounted in the tubular handle in various ways. As shown in FIGS. 1 and 2, the battery is mounted in a separate U-shaped carrier 58 that can be removed from the tubular handle, e.g. during manufacturing operations required for installation of lead wiring. Electric contacts at opposite ends of carrier 58 provide electrical connections between the battery and switch 20 and motor 12. Linear guides 60 molded into handle section 36 position carrier 58 in the tubular handle. As viewed in FIG. 1, the carrier is lowered into handle section 36, in order to position the carrier in the handle. Fixed contacts 62 in handle section 36 mate with contacts on carrier 58 when the carrier is in its installed position. Hard wiring (not shown) join contacts 62 to the motor and manual switch 20.

As previously noted, detergent storage chamber 28 supplies liquid detergent to the cleaning element 26. A port 69 in tubular guide 42 communicates with a transverse hole 70 in shaft 16 when the shaft is rotating, whereby liquid detergent is delivered from chamber 28 to an axial passage 72 in the shaft. Passage 72 communicates with chamber 30 in pad 24 to supply detergent to the sponge cleaning element. The interior surface of passage 72 can have a spiral groove therein to generate a pumping action on the detergent. Otherwise the flow is gravitational.

A principal feature of the invention is the construction of tubular handle 10. The handle is split into two molded half connections 34 and 36, connected together by multiple screws 40. A single unitary gasket 38 is located in the plane of the split between the handle sections. Guide tube 42 is located in handle section 36 offset from the handle axis, such that gasket 38 can be a unitary structure having a continuous uninterrupted sealing action on the edge surfaces of the handle sections 34 and 36.

Having described my invention, I claim:

1. A portable device for washing hollow ware, comprising:

a hollow tubular handle having a longitudinal axis; said handle being split on a longitudinal plane containing said axis, whereby said handle comprises first and second handle sections;

transverse partition means in said handle sections forming a detergent storage chamber;

a tubular guide extending parallel to said longitudinal axis within said first handle section; said tubular guide passing through said detergent chamber;

a rotary shaft supported in said tubular guide;

an electric motor in said hollow tubular handle operatively connected to said shaft, so that when said motor is energized the shaft rotates;

a cleaning element attached to said shaft for cleaning hollow ware when said shaft is inserted therein; and passage means for conveying detergent from said detergent chamber into said shaft and along said shaft into said cleaning element.

2. The device of claim 1, wherein said passage means comprises a port in said tubular guide, a transverse radial hole in said shaft communicating with said port when said shaft is rotating, and an axial passage in said shaft extending from said transverse hole to said cleaning element.

3. The device in claim 1, wherein said tubular guide is offset from the plane of the split between said first and second handle sections.

4. The device of claim 1, wherein the split between said first and second handle sections is disposed in a single plane containing the handle longitudinal axis.

5. The device of claim 1, wherein the split between said first and second handle sections is disposed in a single plane containing the handle longitudinal axis; and an endless gasket interposed between said handle sections in the split plane.

6. The device of claim 5, wherein said first and second handle sections have aligned mating edge surfaces, each of said edge surfaces having an endless groove therein; said endless gasket being located in said endless grooves so that one half of the gasket cross section is seated in each groove.

7. The device of claim 6, wherein said gasket has a circular cross section.

8. The device of claim 1, and further comprising a speed reducer gearing arrangement interposed between said motor and said shaft.

9. The device of claim 8, wherein said motor is coaxial with said shaft.

10. The device of claim 1, wherein said tubular handle has a circular cross section.

11. The device of claim 1, and further comprising a dry cell battery in said tubular handle operatively connected to said motor.

12. The device of claim 1, wherein each said handle section has a semi-circular cross section.

13. The device of claim 1, and further comprising plural screws extending from one handle section into the other handle section to join said handle sections together; said screws being located within the handle cross section so that the handle has a smooth outer surface.

14. The device of claim 1, wherein said transverse partition means comprises two parallel walls extending transverse to said longitudinal axis in each handle section; each of said walls having a free edge in the plane of the split between the handle half sections.

15. The device of claim 14, and further comprising an endless gasket interposed between said handle sections in the split plane; said gasket including integral gasket limbs extending along the free edge of said parallel walls.

16. The device of claim 1, wherein said cleaning element is a sponge having a circular shape in a plane normal to the axis of the rotary shaft.

17. The device of claim 16, wherein said tubular handle has a circular cross section; said circular sponge and said circular handle having approximately the same diameter.

* * * * *